US010563934B2

(12) United States Patent
Uhland

(10) Patent No.: US 10,563,934 B2
(45) Date of Patent: Feb. 18, 2020

(54) DEVICE FOR COLLECTING A CONDENSATE

(71) Applicant: Buechi Labortechnik AG, Flawil (CH)

(72) Inventor: Martin Uhland, Goldach (CH)

(73) Assignee: BUECHI LABORTECHNIK AG, Flawil (CH)

( * ) Notice: Subject to any disclaimer, the term of this patent is extended or adjusted under 35 U.S.C. 154(b) by 12 days.

(21) Appl. No.: 15/744,348

(22) PCT Filed: Jun. 29, 2016

(86) PCT No.: PCT/EP2016/065112
§ 371 (c)(1),
(2) Date: Jan. 12, 2018

(87) PCT Pub. No.: WO2017/009043
PCT Pub. Date: Jan. 19, 2017

(65) Prior Publication Data

US 2018/0195817 A1 Jul. 12, 2018

(30) Foreign Application Priority Data

Jul. 16, 2015 (EP) ..... 15177051

(51) Int. Cl.
*F28F 17/00* (2006.01)
*F24F 13/22* (2006.01)
*F28F 27/02* (2006.01)

(52) U.S. Cl.
CPC ..... *F28F 17/005* (2013.01); *F24F 13/222* (2013.01); *F28F 27/02* (2013.01); *F24F 13/22* (2013.01)

(58) Field of Classification Search
CPC ..... F28F 17/005; F28F 27/02; F24F 13/222; F24F 13/22; F24F 13/224; F24F 2013/227; B01D 5/009; F25D 21/14
USPC ..... 62/291
See application file for complete search history.

(56) References Cited

U.S. PATENT DOCUMENTS 1,861,619 A 6/1932 Bellmer
4,687,604 A 8/1987 Goettl
4,893,481 A * 1/1990 Sullivan ..... F24F 13/22 29/402.08

(Continued)

FOREIGN PATENT DOCUMENTS

CN 2009 85130 Y 12/2007
DE 538 619 11/1931

(Continued)

OTHER PUBLICATIONS

Machine translation of WO 2004025200A1, Wolfgang Moser, Pub. Mar. 2004.*

(Continued)

*Primary Examiner* — Joseph F Trpisovsky
(74) *Attorney, Agent, or Firm* — Davis & Bujold PLLC; Michael J. Bujold

(57) ABSTRACT

A device (1) for collecting a condensate, comprising a collecting receiver (2) with a base region (3), at least one lateral wall (4), and a contact surface (5) to be brought into contact with a counter piece of a condensate-forming element. The collecting receiver (2) can be placed, at least partially peripherally, with the contact surface (5) against said condensate-forming element.

10 Claims, 3 Drawing Sheets

(56) References Cited

U.S. PATENT DOCUMENTS

Figure 1:
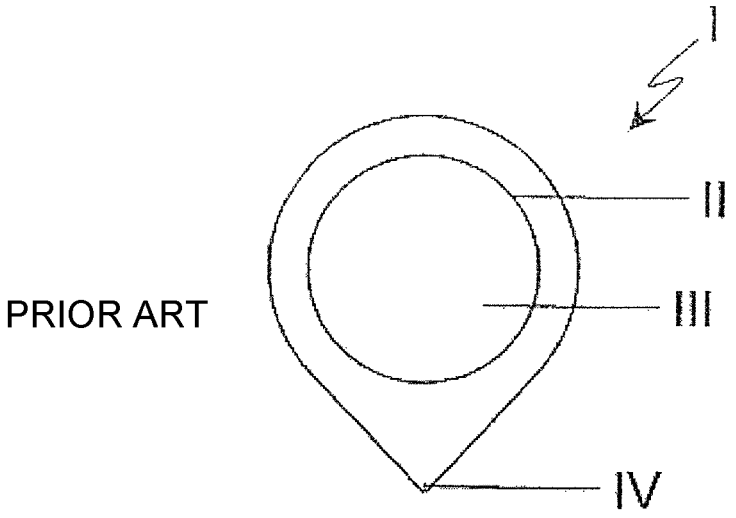

| | | | | |
|---|---|---|---|---|
| 5,071,027 | A | 12/1991 | Sullivan | |
| 5,481,886 | A * | 1/1996 | Hasegawa | F24F 13/22 165/913 |
| 2005/0109055 | A1 | 5/2005 | Goetzinger et al. | |
| 2012/0159981 | A1 | 6/2012 | Beck et al. | |

FOREIGN PATENT DOCUMENTS

| | | | | |
|---|---|---|---|---|
| DE | 36 14 658 | A1 | 11/1987 | |
| DE | 41 40 130 | A1 | 10/1992 | |
| DE | 195 17 398 | A1 | 11/1995 | |
| DE | 101 27 796 | C1 | 10/2002 | |
| EP | 1 739 365 | A1 | 1/2007 | |
| WO | WO-2004025200 | A1 * | 3/2004 | F25D 21/14 |

OTHER PUBLICATIONS

International Search Report Corresponding to PCT/EP2016/065112 dated Oct. 12, 2016.
Written Opinion Corresponding to PCT/EP2016/065112 dated Oct. 12, 2016.
European Office Action issued in corresponding European Patent Application No. 16 734 289.8 dated Mar. 26, 2019.
Chinese Office Action dated Mar. 19, 2019 corresponding to Chinese Appln. No. 201680045094.1.
European Office Action issued in corresponding European Patent Application No. 16 734 289.8 dated Sep. 10, 2019.

* cited by examiner

DEVICE FOR COLLECTING A CONDENSATE

The invention relates to a device for collecting a condensate and to the use of such a device.

Condensates form on outer regions of apparatuses, for example on evaporation systems, at relatively high air humidity if the ambient temperature lies significantly above the temperature of the apparatus. This leads to condensation of water from the ambient air on outer regions of the apparatus, the water flowing downward on the apparatus and accumulating on laboratory benches or laboratory floors. This takes place above all on coolers, for example reflux coolers of evaporation systems. Furthermore, the formation of condensate on apparatuses, in particular on evaporation systems, leads to problems during removal of containers or flasks. Condensate dripping down contaminates the contents of the container/flask by dripping into the container. Condensate below is always understood to mean a condensate which forms on the outer surface of an apparatus because of the humidity of the air.

Solutions for directed dripping down of condensates on apparatuses are known in the prior art. One solution is an elastic plastics part which is placed in the shape of a collar onto apparatuses, wherein the plastics part has a tapering outer region which is suitable for the directed dripping down of condensate collected on the plastics part. A collecting cup which collects the dripping-down condensate can be placed, for example on the laboratory bench, below the tapering outer region. A disadvantage of this is that access to the container/flask is restricted because of the position of the collecting container. Furthermore, during removal of the container/flask of the apparatus, care has to be particularly taken to ensure that the condensate dripping down from the plastics part does not drip into the container/flask.

It is the object of the invention to overcome the disadvantages of the prior art. In particular, it is the object of the invention to ensure controlled collecting and/or conducting away of a condensate on an apparatus.

These objects are achieved by the device with the features of independent patent claim 1.

The invention relates to a device for collecting a condensate, comprising a collecting channel with a bottom region, at least one side wall and a contact surface for brining into contact with a condensate-forming element. "Bringing into contact" is understood here and below as "making contact". The collecting channel can be placed here, in an at least partially encircling manner, with the contact surface against the condensate-forming element. This provides a device which collects and gathers a condensate in the collecting channel. In this manner, no uncontrolled dripping of the condensate and no contamination of containers/flasks by dripping-down condensate take place. Furthermore, good contactability of the device with the condensate-forming element for collecting a condensate, and simple retrofitting of customary laboratory apparatuses, such as, for example, distillation systems, in particular rotary evaporators, are provided. In this manner, in particular condensate from the outer regions of a cooler, in particular reflux cooler, is collected and gathered. The collecting channel is configured in such a manner that it can be placed around a condensate-forming element and is in particular of flexible design. The device can thus be placed beyond a thick region, in particular a flange, onto a thin region of the condensate-forming element for the operating state. Flexible is understood here and below as meaning that the device or one or more regions of the device is or are bendable, stretchable and/or elastic. It is thus particularly advantageously possible for the device to be arranged around condensate-forming elements and to ensure good lying against the condensate-forming element.

It is possible for the collecting channel to be able to be placed onto the counterpart of a condensate-forming element in such a manner that the collecting channel at least completely encircles the element, in particular in the operating state. Condensate which runs down over the entire surface of the condensate-forming element is thereby collected. In the operating state, the collecting channel can lie with a subregion of the contact surface against the element and can have a region in which the contact surface is not in contact with the element. Different sizes of the element can thereby be covered by the device.

The device can have an outlet for conducting away a collected condensate. The outlet is arranged here on the collecting channel. The collected condensate can thereby be conducted away from the collecting channel. The device is thus not limited to the volume of the collecting channel for receiving the condensate, but rather a condensate which flows downward continuously can be collected and conducted away. Large volumes of condensate can thereby be conducted away. Continuous operation is thus possible.

A supporting surface for receiving a counter surface of the condensate-forming element can be arranged adjacent to the contact surface. The counter surface is provided, for example, by a flange of a reflux cooler, on which the device is arranged.

The outlet can be arranged at the lowest point of the collecting channel, in particular at a lowest point of the bottom region here. Said lowest point is understood as meaning the lowest point in the operating state of the device, i.e. when the device is attached to an apparatus. Alternatively, the outlet can be arranged on the upper edge of the side wall or of the contact surface or can be embedded in the side wall.

The outlet can have a connecting element, in particular a hose connector. Collecting condensate can thereby be conducted away by the outlet into a conducting-away system, in particular a hose system, which is connected downstream via the connecting element, in particular hose connectors. The collecting and conducting-away capacities can thereby be increased. Another advantage is that the condensate can be conducted away in a controlled manner into a separate collecting container without causing contaminations of working or floor surfaces in the process. The condensate no longer drips downward, but rather is conducted away in a controlled manner, and therefore contamination of containers/flasks which are removed from the system is prevented.

The device or one or more regions of the device can be manufactured from elastic material. In particular, they can be manufactured from silicone rubber (Q/MQ), fluororubber (FPM), fluoro-silicone rubber (FMQ), ethylene-propylene-diene rubber (EPM/EP), polyacrylate elastomer (ACM), epichlorohydrin rubber (ECO/CO), chloroprene rubber (CR), hydrated nitrile-butadiene rubber (HNBR), nitrile-butadiene rubber (NBR), butyl rubber (IIR), polyurethanes (AU, EU), styrene-butadiene rubber (SBR). For example, the plastic which is sold under the tradename Santoprene™ 8201-70 from Exxon Mobile Chemical can be used for manufacturing the device or for one or more regions of the device. By means of the use of elastic material, the device can simply be placed or adapted to a condensate-forming element. The device can be particularly advantageously placed here on elements of different sizes, wherein high tightness between the device and condensate-forming element is ensured. Accordingly, an apparatus can also advantageously be retrofitted with the device according to the invention.

The device can be of integral design. The device can thus be produced simply and cost-effectively. The device can also be a multi-part design, for example in the form of an O-ring, which can be positioned on the contact surface of the collecting channel, with a separately manufactured collecting channel.

The device can have a further condensate-collecting and/or condensate-conducting-away part, in particular a second, in particular, flexible collecting channel. The further condensate-collecting and/or condensate-conducting-away part can be arranged at a junction of the condensate-forming element as a second condensate-forming element. If the further condensate-collecting and/or condensate-conducting-away part is configured as a second in particular flexible collecting channel, the latter thus comprises a bottom region, at least one side wall and a contact surface for bringing into contact with a condensate-forming element. The device can thereby be placed against further elements or against additional positions of the condensate-forming element. This is of advantage in particular in the case of evaporation systems, in particular rotary evaporators, and coolers, in particular reflux coolers. For example, the first collecting channel can be attached to the lower region of a reflex cooler, for example in the transition region to a collecting flask, while the further condensate-collecting and/or condensate-conducting-away part is arranged, in the case of a glass branch, in the region of a flange for attaching a further apparatus, in particular a vapor feedthrough to an evaporation flask of a rotary evaporator. Contamination of an evaporation flask and/or of the collecting flask during attaching and/or removing of the flask to/from the apparatus can thereby be avoided.

The first collecting channel can be connected to the further condensate-collecting and/or condensate-conducting-away part in such a manner that the condensate of both parts gathers in the first collecting channel. The condensate which is formed is thereby conducted away particularly simply.

The collecting channel can be closed in the circumferential direction and can have a first, in particular circular, recess for receiving a condensate-forming element. Collecting of condensate is thus ensured in a particularly advantageous manner. A closed collecting channel is understood here and below as meaning that the collecting channel encircles the recess and has no start and no end.

The recess can have a diameter of 10 mm to 50.8 mm (0.4 to 2 inches), preferably of 19 mm to 31.75 mm (0.75 to 1.25 inches), particularly preferably 22 mm to 28 mm (0.9 to 1.1 inches). Very particularly preferably, the recess has a diameter of 25.4 mm (1 inch). The device can thereby be placed around condensate-forming elements having the abovementioned diameters and can therefore be used advantageously in the laboratory sector. By means of a flexible configuration, even condensate-forming elements having diameters differing from these values can be accommodated.

The second condensate-collecting part can have a second, in particular circular, recess with a contact surface for receiving a second condensate-forming element. The device can thereby be positioned tightly around the corresponding counterpart.

The second recess of the second condensate-collecting part can span an area which is positioned at an angle of 90° to 165°, preferably 120°, relative to an area spanned by the first recess. The device can thereby be placed around branched glass elements of an apparatus, in particular of a rotary evaporator, and can collect condensate flowing downward. In particular, the device can be placed in this manner onto a cooler, in particular a reflux cooler. By means of a flexible configuration, other angles can also be easily set.

The second recess can have a diameter of 25.4 mm to 50.8 mm (1 to 2 inches), preferably 42 mm (1.65 inches). By means of a flexible configuration, diameters having deviating values can also be accommodated.

Furthermore, an edge of the second recess can have a supporting surface for receiving a countersurface. The device can thereby be optimally positioned on a countersurface of the condensate-forming element, in particular a flange.

The collecting channel can be an open collecting channel with at least one end region which is closed on an end side. When the collecting channel is attached, the closed end region is preferably placed lower than an open end region.

The device can comprise an outlet for conducting away a condensate in the end region of the collecting channel. The outlet is positioned here in an end region of the collecting channel, said end region forming the lowest point of the collecting channel during use in accordance with the operation. In this manner, during use as intended, the condensate collected in the collecting channel flows into the end region, in particular into the lowest point, of the collecting channel and can be conducted out via the outlet.

The device or one or more regions of the device can be plastically deformable. Plastic deformation is understood here and below as meaning that the device or regions of the device maintains or maintain its or their shape after deformation, i.e. the device permanently adopts this deformed shape until the device is deformed again. The device can thus be adapted optimally according to the situation or use to a corresponding counterpart.

The device or one or more regions of the device can be elastically deformable. Elastic deformation is understood here and below as meaning that the device or regions of the device is or are deformable and resumes or resume or attempts or attempt to resume its or their original shape existing prior to the deformation. If the device is configured to be elastically deformable, it can be configured in particular spirally. It can therefore be particularly readily adapted to a cylindrical counterpart and can be placed against elements having different sizes or diameters.

Furthermore, the invention relates to the use of a device as previously explained for collecting and/or conducting away a condensate on a cooler, in particular a reflux cooler, of an evaporation system, in particular on a rotary evaporator.

A further aspect of the invention relates to an evaporation system, in particular a rotary evaporator, having a device as previously explained, and to the use of said evaporation system for collecting and/or conducting away a condensate on a cooler. An evaporation system is thereby provided which overcomes the disadvantages of the prior art, in particular accumulation of condensate on laboratory tables or floors and contamination of vessels which are to be attached to or are to be removed from the apparatus.

Furthermore, the invention relates to a method for collecting and/or conducting away a condensate of an evaporation system, in particular a rotary evaporator, wherein condensate of a condensate-forming element is collected and/or conducted away in a collecting channel of the device, as previously explained. The condensate is formed here on the outer surface of an apparatus by the humidity of the air.

Condensate formed on an outer region of an evaporation system is thereby simply gathered and/or conducted away.

Figure 2:
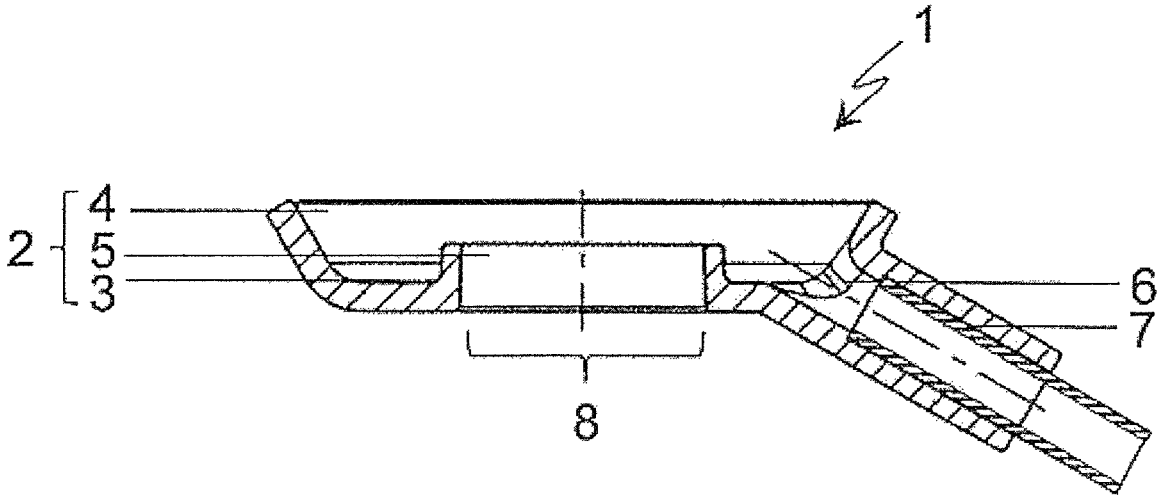
Figure 3:
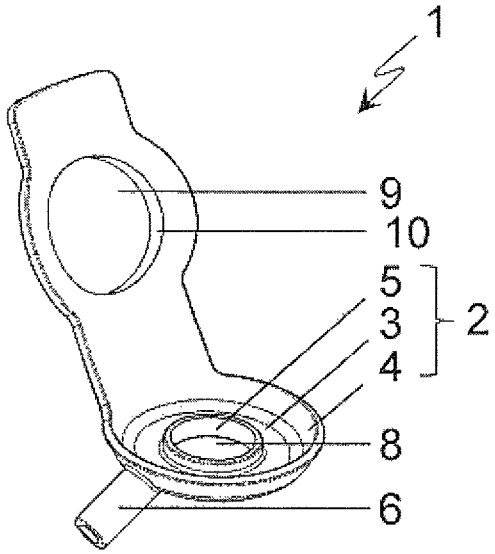
Figure 4:
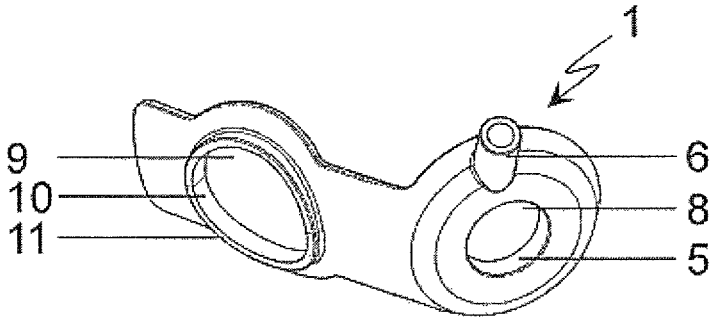
Figure 5:
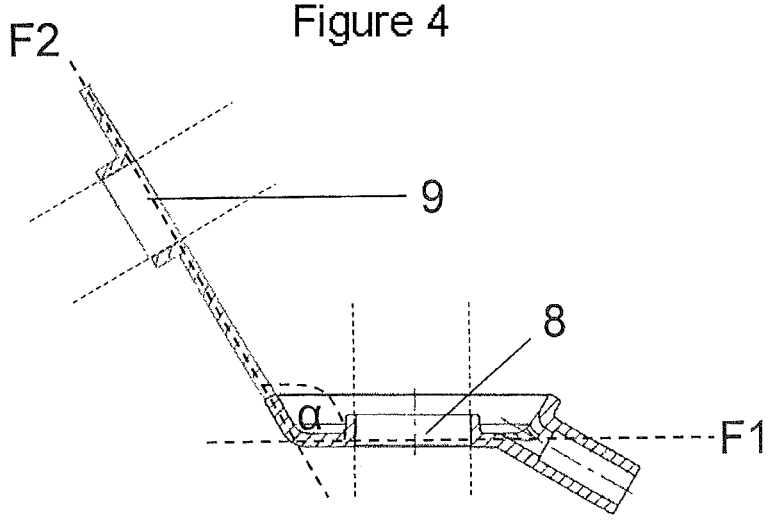
Figure 6A:
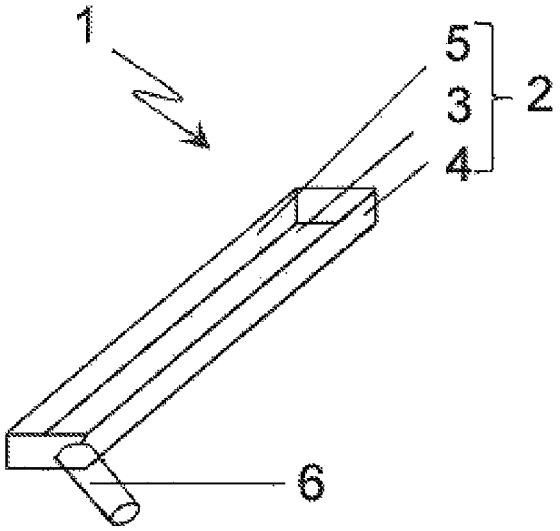
Figure 6B:
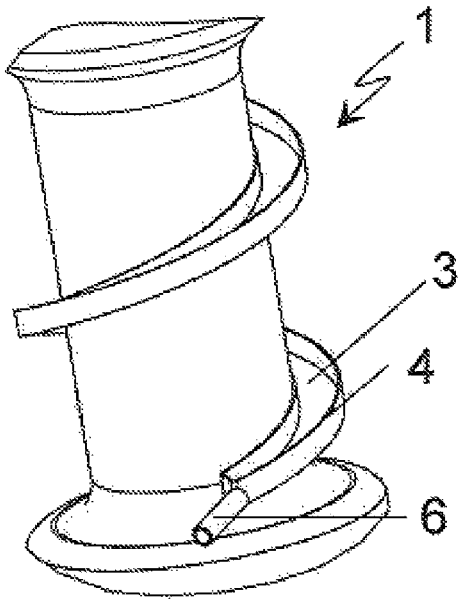
Figure 7:
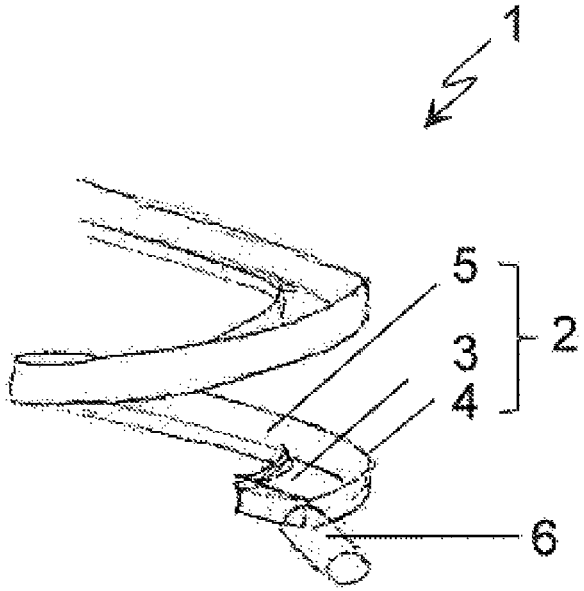

The invention is explained in more detail below with reference to figures and exemplary embodiments, in which:

FIG. 1: shows a device for the directed dripping down of condensate from the prior art;

FIG. 2: shows a vertical section through a device according to the invention for collecting a condensate;

FIG. 3: shows a perspective view of a further embodiment of a device according to the invention obliquely from above;

FIG. 4: shows a perspective view of the device from FIG. 3 obliquely from below;

FIG. 5: shows a vertical section of the device from FIGS. 3 and 4;

FIG. 6*a*: shows a further embodiment of a device according to the invention for collecting a condensate, similarly to a flexible curve ruler;

FIG. 6*b*: shows a further embodiment of a device according to the invention for collecting a condensate, similarly to a flexible curve ruler, during use as intended;

FIG. 7: shows a further embodiment of a device according to the invention for collecting a condensate, similarly to a spiral cable connector.

FIG. 1 shows a device I for collecting and conducting away a condensate from the prior art. The device I is configured as a plastics part with a seam II. The seam II runs completely around a punched recess III and has a tapering outer region IV. In the operating state, the punched recess III is placed around a condensate-forming element, wherein a condensate is gathered at the seam II. The gathered condensate drips downward via the tapering outer region IV. The dripping-down condensate is collected, for example, in a collecting cup which is not shown here and, in the operating state, is positioned under the tapering outer region IV. This device is advantageously arranged in an inclined plane such that the tapering region forms the lowest point. However, this is not always straightforward.

FIG. 2 shows a vertical section through a device 1 according to the invention for collecting a condensate. The device 1 has a collecting channel 2 which comprises a bottom region 3, a side wall 4 and a contact surface 5. The contact surface 5 defines a recess 8. An outlet 6 is arranged in the bottom region 3 of the device 1. A connecting element 7 via which a collected condensate can be conducted away is located in the outlet 6. In the operating state, the contact surface 5 is in contact with a condensate-forming element, for example with the lower region of a reflux cooler. A condensate flowing down from the condensate-forming element is collected in the collecting channel 2. The collecting channel 2 which is bounded by the bottom region 3, the side wall 4 and the contact surface 5 has a collecting volume. A collected condensate is conducted out via the outlet 6. A conducting-away system (not shown here), for example a hose, can be connected to the connecting element 7. The device 1 is manufactured from Santoprene™ 8201-70.

FIGS. 3 and 4 show a further embodiment of a device 1 according to the invention in various views. FIG. 3 shows a perspective view obliquely from above and FIG. 4 a perspective view obliquely from below. The device 1 is substantially identical to the device from FIG. 2 and has a collecting channel 2. The collecting channel 2 comprises a bottom region 3, a side wall 4 and a contact surface 5. An outlet 6 is arranged in the bottom region 3 of the device 1. The contact surface 5 defines a recess 8. The collecting channel 2 completely encircles the recess 8. The recess 8 spans an area which, in the operating state, can be positioned substantially horizontally on a condensate-forming element.

The device 1 of FIGS. 3 and 4 differs from the device from FIG. 2 by means of a further condensate-collecting and/or condensate-conducting-away part, a second recess 9 and a contact surface 10 of the recess 9. The further condensate-collecting and/or condensate-conducting-away part has a supporting surface 11 on the edge of the second recess. In the operating state, the device 1 is positioned by means of the recesses 8 and 9 around two condensate-forming elements or at two positions of a condensate-forming element. Condensate running downward at the condensate-forming elements or the condensate-forming element is collected via that region of the device which encircles the recess 9 and is conducted to the collecting channel 2 and/or is collected directly in the collecting channel 2 and conducted away via the outlet 6.

FIG. 5 shows a vertical section of the device from FIGS. 3 and 4. The first recess 8 for receiving a condensate-forming element spans an area F1. The recess 9 of the second condensate-collecting part spans a second area F2. The second area F2 spanned by the recess 9 is positioned at an angle $\alpha$ of substantially 120° relative to the area F1 spanned by the first recess 8.

FIGS. 6*a* and 6*b* show a further embodiment of a device 1 according to the invention composed of a plastically deformable material similar to a flexible curve ruler. The device 1 has a collecting channel 2 and an outlet 6. The collecting channel 2 has a bottom region 3, a side wall 4 and a contact surface 5. The device is of basically elongate design (FIG. 6*a*). For the operating state, the device 1 is placed against a condensate-forming element and is deformed in such a manner that the device 1 lies in an accurately fitting manner against the condensate-forming element (FIG. 6*b*). The device 1 permanently maintains this shape until the device is deformed again or removed. The device 1 can therefore be optimally adapted or is optimally adapted according to the situation or use to a corresponding counterpart. The closed end region which is positioned at the lowest point in the operating state comprises an outlet 6. Gathered condensate can be conducted out via said outlet and can optionally be conducted away in a manner directed by a connected hose.

FIG. 7 shows a further embodiment according to the invention of the device 1 composed of an elastically deformable material which behaves similarly to a spiral cable connector. The device 1 has a collecting channel 2 and an outlet 6. The collecting channel 2 has a bottom region 3, a side wall 4 and a contact surface 5. The device 1 is configured spirally. The elastic material is deformable, but resumes its shape existing before deformation or attempts to resume the shape existing before the deformation. Owing to the elastic properties of the material, the contact surface 5 is pressed against a corresponding cylindrical counterpart, and therefore the device is adapted particularly advantageously in the operating state. The device 1 can thus be advantageously placed against condensate-forming elements having different sizes or diameters. The collecting channel 2 has a length such that the device 1 at least completely encircles a corresponding counterpart. Condensate which flows down over the entire surface of the condensate-forming element is thus collected and can be conducted out via the outlet 6 in the closed end region of the lowest point of the collecting channel 2.

The invention claimed is:

1. A device for collecting a condensate, the device comprising:

a first collecting channel with a bottom region, at least one side wall, a contact surface for bringing into contact with a condensate-forming element, and the first collecting channel being of a flexible design, wherein the first collecting channel can be placed, in an at least partially encircling manner, with the contact surface against the condensate-forming element, the device has a second condensate-collecting part in a form of a second flexible collecting channel, which can be arranged on a second condensate-forming element, the first collecting channel is closed, in the circumferential direction, and has a first recess for receiving the condensate-forming element, the second condensate-collecting part has a second recess with a contact surface for receiving the second condensate-forming element, and the recess of the second condensate-collecting part spans an area which is positioned at angle of 90° to 165° relative to an area spanned by the first recess.

2. The device as claimed in claim 1, wherein the first collecting channel can be placed against the condensate-forming element in such a manner that the collecting channel at least completely encircles the element.

3. The device as claimed in claim 1, further comprising an outlet for conducting away a collected condensate, wherein the outlet is arranged on the first collecting channel.

4. The device as claimed in claim 1, wherein the device, or one or more regions of the device, is or are manufactured from an elastic material.

5. The device as claimed in claim 1, wherein the device is formed integrally.

6. The device as claimed in claim 1, wherein the first recess has a diameter of between 10 mm to 50.8 mm.

7. The device as claimed in claim 1, wherein the recess of the second condensate-collecting part has a diameter of 25.4 mm to 50.8 mm.

8. A method for at least one of collecting or conducting away a condensate on a cooler of an evaporation system using a device as claimed in claim 1.

9. An evaporation system having a device as claimed in claim 1.

10. A method for at least one of collecting or conducting away a condensate of an evaporation system, wherein condensate of a condensate-forming element is at least one of collected or conducted away in a collecting channel of a device as claimed in claim 1.

* * * * *